United States Patent [19]

Rynik et al.

[11] 4,409,870

[45] Oct. 18, 1983

[54] APPARATUS FOR CONTINUOUSLY CUTTING AND REMOVING THIN TRIM STRIPS FROM A PRINTED WEB

[75] Inventors: Milan Rynik, Scarsdale, N.Y.; John Nickel, Passaic, N.J.

[73] Assignee: Blava In-line, Inc., Carlstadt, N.J.

[21] Appl. No.: 187,054

[22] Filed: Sep. 15, 1980

[51] Int. Cl.[3] ..... B26D 7/18

[52] U.S. Cl. ..... 83/100; 83/24; 83/88; 83/349; 270/21.1

[58] Field of Search ..... 83/100, 86, 88, 349, 83/23, 24, 324; 270/21.1

[56] References Cited

U.S. PATENT DOCUMENTS

| | | | |
|---|---|---|---|
| 1,280,367 | 10/1918 | Barber . | |
| 3,015,978 | 1/1962 | Innocenti | 83/324 |
| 3,060,775 | 10/1962 | Dreher | 83/100 |
| 3,166,965 | 1/1965 | Stemmler | 83/175 |
| 3,194,095 | 7/1965 | Buck et al. | 83/100 |
| 3,209,630 | 10/1965 | McCartan | 83/100 |
| 3,308,701 | 3/1967 | Frohling | 83/324 |
| 3,410,162 | 10/1968 | Ruggeri | 83/100 |
| 3,733,872 | 5/1973 | Gregoire | 72/213 |
| 3,799,536 | 3/1974 | Gregoire | 270/61 |
| 3,847,045 | 11/1974 | Willhite et al. | 83/349 |
| 3,857,314 | 12/1974 | Gregoire | 83/346 |
| 3,889,939 | 6/1975 | Faltin | 270/21.1 |
| 3,893,359 | 7/1975 | Gregoire | 83/154 |
| 3,899,947 | 8/1975 | Faltin | 83/113 |
| 3,949,591 | 4/1976 | Gregoire | 72/310 |
| 4,037,501 | 7/1977 | Gladow | 83/100 |
| 4,047,711 | 9/1977 | Gregoire | 270/86 |
| 4,073,485 | 2/1978 | Gregoire | 270/21 |
| 4,113,243 | 9/1978 | Gregoire | 270/21 |
| 4,270,910 | 6/1981 | Himmelsbach | 83/100 |

OTHER PUBLICATIONS

Gregg Engineering Corp. Catalogue, "3-76" on back page, Gregg Engineering Products, Lyons, Ill.

The Scheffer Pre-Folder (undated), Scheffer Automatic, Inc., Crown Point, IN.

*Primary Examiner*—Donald R. Schran

*Attorney, Agent, or Firm*—Gottlieb, Rackman & Reisman

[57] ABSTRACT

An apparatus for continuously cutting thin trim strips from a moving printed web so as to form uniform web products and removing the trim strips from the cutting area is provided, for in-line operation with a web press. The gapping of the web is effected by a cutting cylinder with a hollow bore, which carries at least two pairs of spaced cutting knives that act against a stationary shear blade. The space between each pair of blades connects with the cylinder bore, which in turn is connected to a low-pressure source. As a printed web is fed to the cutting cylinder, the spaced knives cut trim strips in the web and these strips are removed through the space and the cylinder bore by air flow caused by the low-pressure source. The circumferential speed of the knives acting on the web is greater than the speed of the web itself, this reducing any bubbling of the web, and the width of the space between knives is greater than the width of the trim strip. This system enables removal of trim strips down to a width in the range of 1/16".

10 Claims, 9 Drawing Figures

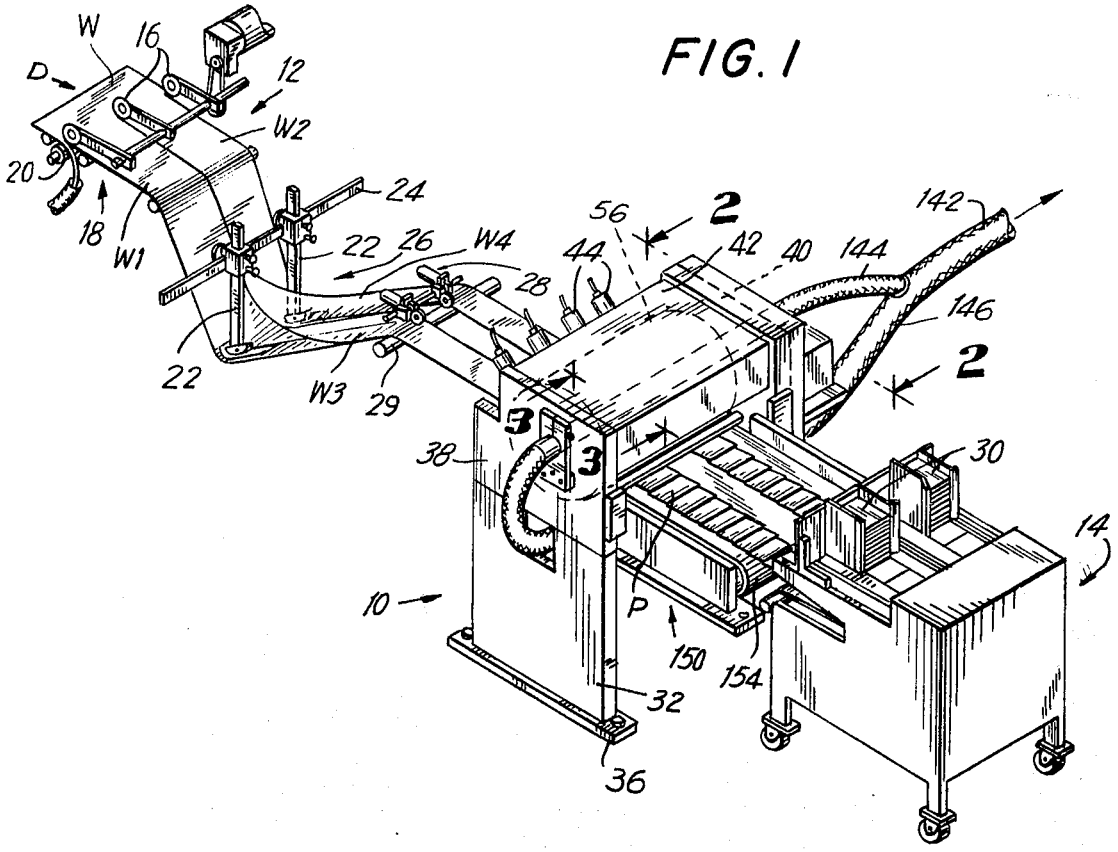
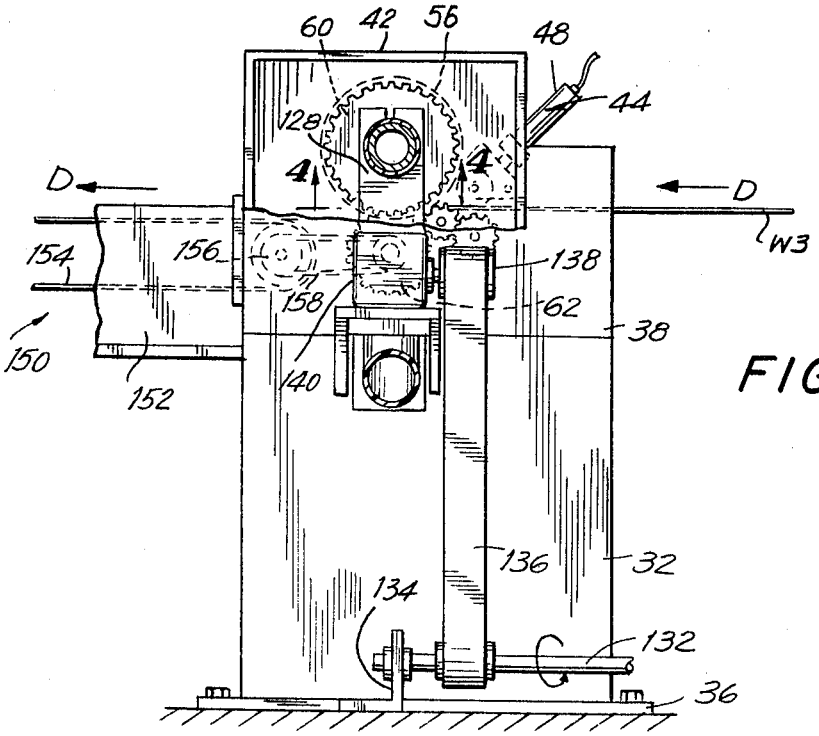
FIG. 2

APPARATUS FOR CONTINUOUSLY CUTTING AND REMOVING THIN TRIM STRIPS FROM A PRINTED WEB

This invention relates to a gap-cutting apparatus for use in-line with printed webs coming off a web press. More particularly, it is concerned with a gap-cutting apparatus which will quickly and efficiently cut thin trim strips from a moving printed web in a continuous manner, in order to form uniform finished web products. The trim strips that are cut, may be as small as 1/16" in width and are by low-pressure means removed from the area of the cutting knives so as to prevent clogging at the cutting area.

In the prior art and in the printing industry, apparatus for operating in-line at the output end of a web press are well known. Printed web is projected from such web presses at rates up to 1600 feet per minute.

In prior web product processing, the web coming from a web press was simply cut into sheets of uniform size, stacked and then sent to a bindery. There, further operations would take place on these sheets, including further cutting, trimming, gluing and folding. In newer technology, developed over the last few years, the operations which formerly took place at the binary have been revised. Rather, the various slitting, trimming and folding operations have been carried out at the exit end of the web press on the printed web, while the web is still continuously moving. This is obviously more efficient, economical and less labor-intensive, than the prior methods carried out at the bindery.

Generally, gap-cutting machines play an important role in the printed web finishing process. On occasion it is sufficient to slit the printed web in one or more places to form a finished web product. By way of example, the printing rollers of the press may print one or several identical images on the web during one revolution. These images would then be cut so that the final web product has only one image on it. However, it is commonly found that at the lines of intersection of these images, a bleed area forms which is somewhat unsightly and which should be removed. Furthermore, there is always a non-printed area formed in each revolution of the printing press, due to the lock-up mechanism holding the two ends of the printing plate or blanket wrapped around the plate or blanket cylinder. For these purposes, it is not sufficient simply to cut the web, but rather a small strip has to be removed, consisting of this bleed area or a gap covering the non-printed area.

The prior art has recognized this need, and has been able to commercialize machinery able to cut trim strips of relatively small width. U.S. Pat. No. 4,037,501, issued on July 26, 1977, shows an apparatus capable of removing trim strips of approximately ½" in width. Gregg Engineering Corp. of Lyons, Ill., markets a cutting apparatus which is promoted as being able to remove trim strips ¼" in width.

However, in general, there has not been available any apparatus able to cut and remove trim strips as small as 1/16" in width. It wil be appreciated that the smaller the width of the strip to be removed, the more difficult it becomes to design machinery which can both cut strips of such minimal width and then remove them quickly from the cutting area, so that the strips do not interfere with the cutting process. The desirability of cutting trim strips of widths as small as 1/16" arises from the fact that with such a capability, the printer need remove an absolute minimum amount of material, thereby leaving a maximum amount of area available to be used for the final web product. Of course, once the capability of removing such minimal width strips is achieved in an apparatus, the same apparatus can readily remove strips of greater widths, if that is desired in a particular instance.

In general, the objective of providing apparatus for cutting trim strips of a width down to 1/16" in width, is carried out by providing in such apparatus, a rotatable driven cutting cylinder which carries two or more pairs of spaced cutting knives. The space between each pair of these cutting knives comprises an opening which is in communication with a bore which runs through the center of the cutting cylinder. A low-pressure source is connected to the cutting cylinder bore and therefore the source is also in communication with the space between the knives. A knife edge is also provided to act as a shear against which the pair of knives operate.

Web carrying printed images emerges from the web press and is fed toward the cutting cylinder in a manner such that the web is acted upon by the pairs of spaced knives on the cutting cylinder. Thereby, the pair of knives cuts a gap in the printed web, and the trim strip which has been cut is removed by air flow from the cutting area, by passing through the opening between the knives, through the bore in the cutting cylinder and to the low-pressure source. A stationary sleeve located within the cylinder directs the low-pressure source only to the knives which are then shearing web. The gapping of the printed web forms printed web products of uniform size and finish. A delivery system removes the finished product for further in-line processing, such as stacking.

In order to achieve the ability to cut trim strips of minimal size, as small as 1/16" in width, the speed of the circumference of the cutting cylinder at the knives is faster than the speed of the printed web as it moves toward the cutting cylinder. This over-drive tends to minimize or remove any bubbling in the printed web, which is common in such cutting processes. Such bubbling usually takes place when a moving web is impacted even momentarily by a cutting knife.

With reference to the drawings, which show a preferred embodiment of the invention here disclosed, FIG. 1 is a perspective view of a gap-cutting apparatus situated in-line with respect to a web press, between a plow-folding apparatus and a stacker unit;

FIG. 2 is a cross-sectional view of the gap-cutting apparatus, taken generally along the linee 2—2 of FIG. 1;

Figure 3:
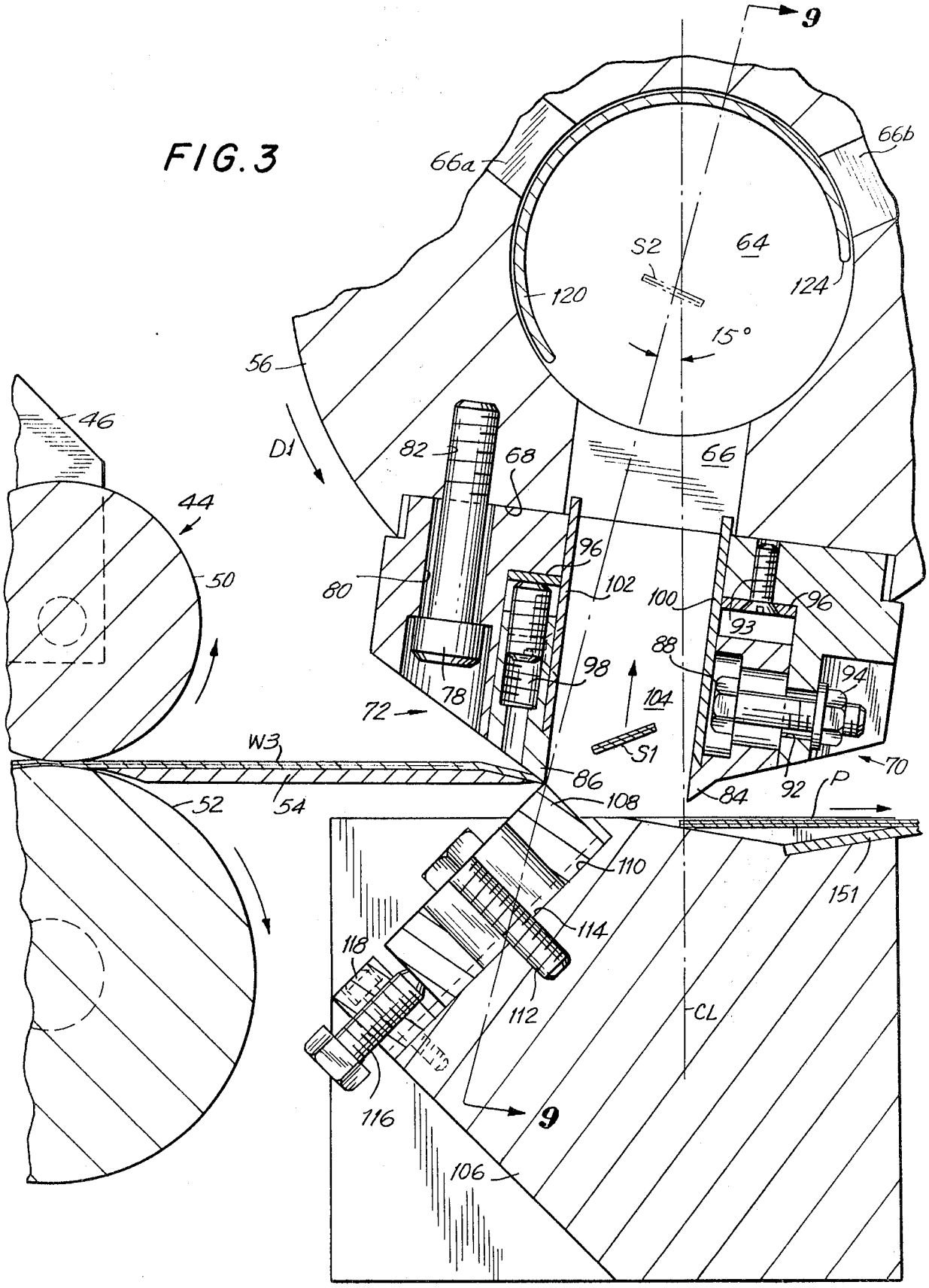
FIG. 3 is an enlarged but partial cross-sectional view of the cutting cylinder and adjacent components of the gap-cutting apparatus, taken generally along the line 3—3 of FIG. 1.

With further reference to the drawings, an overall view of a preferred embodiment of the gap-cutting apparatus 10 is shown in FIG. 1. The apparatus 10 is situated in-line with the output end of a rotary web press, between a plow-folding apparatus 12 and a stacker unit 14. While both the plow-folding apparatus 12 and the stacker unit 14 are known in the art and are commercially available, a brief description of both of these units will enhance understanding of the present invention.

A printed web W emerges from a web press, with multiple printed images thereon, in the direction of the arrow D. The web is operated on by one or more cutting wheels 16 which are situated at a slitting and trimming station 18. The cutting wheels 16 serve both to trim off the unwanted side edges of the web W and to slit the web into two or more slit-web sections, W1 and W2. To act as an anvil in this slitting and trimming function, a driven roller 20 may be provided below the cutting wheels 16.

As the slit-web sections W1 and W2 continue to move in the direction D, they encounter two or more folding plows 22 mounted adjustably on a cross-bar 24. The folding plows 22 are situated at a folding station 26, and serve to fold the slit-web sections W1 and W2 on themselves, into two-leaf folded webs W3 and W4. From this point, the folded webs W3 and W4 pass under nip wheels 28 toward and into the gap-cutting apparatus 10. A driven feed roller 29 is located below the wheels 28.

It should be emphasized that the plow-folding apparatus 12, including the slitting and trimming station 18 and the folding station 26, is merely illustrative of a variety of post-web press operational units which can cut, fold and glue a web W emerging from a web press, and whose slit or folded web can thereupon be operated upon by the gap-cutting apparatus 10. The gap-cutting apparatus of the present invention can operate upon a wide variety of cut, slit and folded web sections which may be fed into it, all in an in-line operation with a web press.

From the gap-cutting apparatus 10 continuously emerges uniformly cut web products which can be stacked into two or more stacks 30 in an automated fashion, by the stacker unit 14. The stacker unit 14 is known in the art and is commercially available, it being typical of a number of different types of apparatus which can operate upon uniformly cut web product emitted by the gap-cutting apparatus 10 of the present invention.

MECHANISM OF GAP-CUTTING APPARATUS

Referring now specifically to the mechanism of the gap-cutting apparatus 10, this unit includes a pair of legs 32 which are mounted on base plates 36 which in turn support numerous other components of the gap-cutting apparatus 10. A pair of frame plates 38, 40 are respectively mounted upon the legs 32. A cover 42 encloses the upper portion of the gap-cutting apparatus 10.

As the folded webs W3 and W4 approach the gap-cutting apparatus 10, they encounter a number of pneumatic nip wheels 44 mounted at the entrance end of the apparatus 10. There may be, as shown in FIGS. 1, 2 and 3 of the drawings, four such pneumatic nip wheels. Each such pneumatic nip wheels includes a pressure arm 46 attached to the piston of a pneumatic cylinder 48. The pressure arm 46 mounts a rotatable pressure wheel 50, which applies pressure to the folded webs W3 and W4 below it.

A feed roller 52 is located below these pressure wheels 50. The folded webs W3 and W4 are driven at a desired speed, between the pressure wheels 50 and feed roller 52 in the direction D, shown in both FIGS. 1 and 2. As the folded webs W3 and W4 continue to move towards the central portion of the gap-cutting apparatus 10, they slide over a web support 54, shown in FIG. 3.

Figure 4:
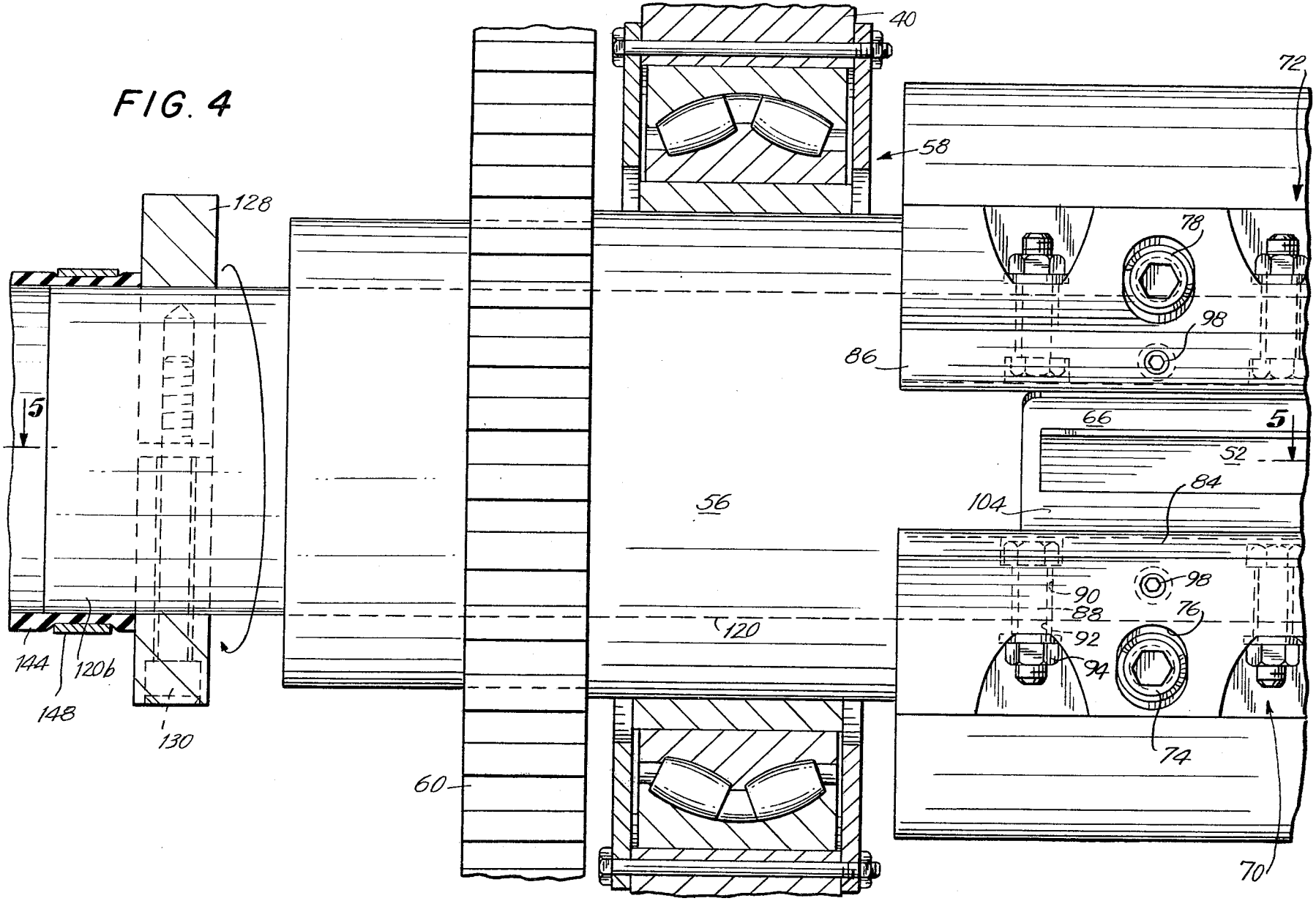
FIG. 4 is a partial bottom plan view of the cutting cylinder and adjacent components, taken generally along the line 4—4 of FIG. 2.

Mounted centrally within the gap-cutting apparatus 10 is a cutting cylinder 56, shown in FIGS. 1, 2 and 3, as well as in other figures later to be described. The cutting cylinder 56, see FIG. 4, is mounted for rotation on its opposed sides in bearings 58. The bearings 58 are held by the frame plates 38, 40.

Figure 5:
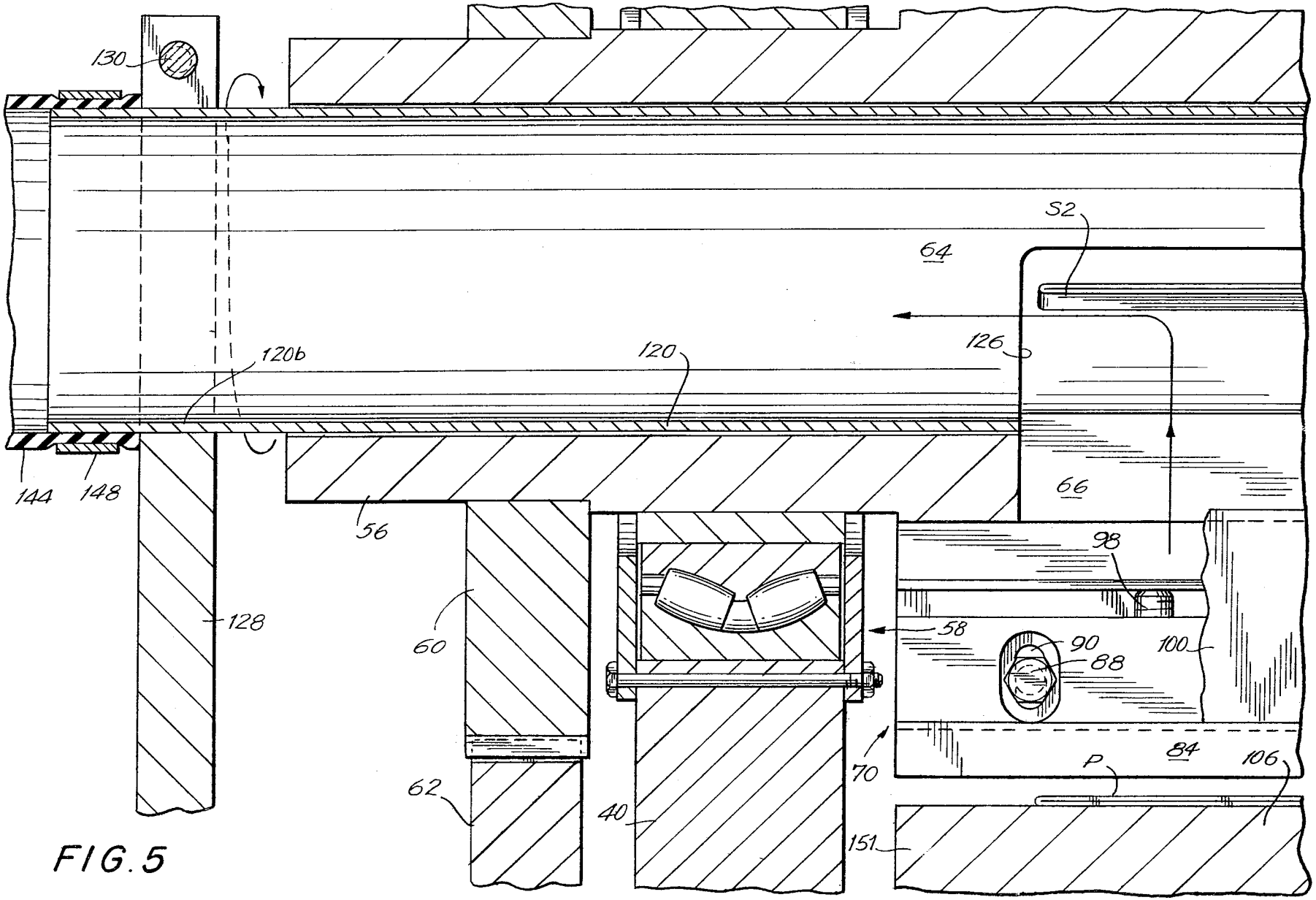
FIG. 5 is a partial cross-sectional view of the cutting cylinder of the gap-cutting apparatus, taken substantially along the line 5—5 of FIG. 4.
Figure 6:
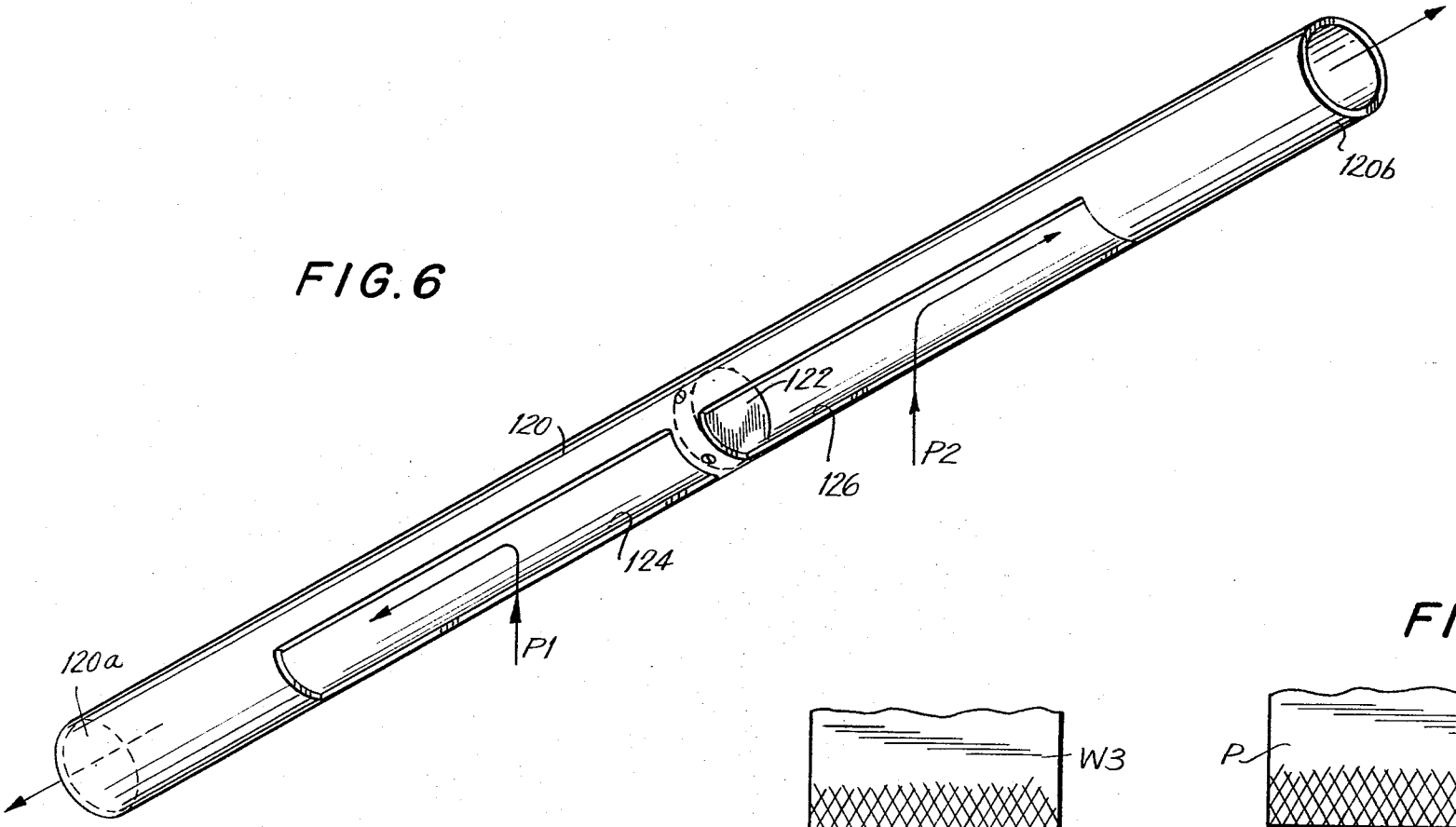
FIG. 6 is a perspective view of the suction sleeve situated within the cutting cylinder.

A cutting cylinder gear 60 is fixed at one end of the cutting cylinder 56, see FIGS. 4 and 5, to enable the cutting cylinder 56 to be driven, through a drive train, including a drive gear 62, to be discussed in detail subsequently.

A pair of spaced knives are retained on the cutting cylinder and define a passage or opening between them which is in communication with the interior of the cutting cylinder. Specifically, as best shown in FIGS. 3, 4, 5 and 9, the cutting cylinder 56 has a hollow central bore 64 extending along its entire axis. Connecting with this cutting cylinder bore 64 are two or more gaps 66 formed in the cutting cylinder which in turn connect with a recess 68 formed in the cutting cylinder 56. Both the gap 66 and the recess 68 extend axially less than the length of the cutting cylinder.

Within the recess 68, and on opposite sides thereof, are mounted a pair of knife holders, specifically a front knife holder 70 and a rear knife holder 72. The terms "front" and "rear" are used, in view of the direction of rotation of the cutting cylinder, as indicated in FIG. 3 by arrow D1.

The front knife holder 70 is held in position in the recess 68 by a front knife holder bolt 74 which passes through an enlarged bore 76 in the front knife holder 70 and then threads into an adjacent portion of the cutting cylinder 56. In a similar fashion, a rear knife holder bolt 78 passes through an enlarged bore 80 in the rear knife holder 72 and is threaded into the cutting cylinder 56 as at 82. The bolts 74, 78 along with additional similar bolt assemblies, retain the front knife holder 70 and rear knife holder 72, respectively, rigidly with respect to the cutting cylinder 56, and within the recess 68. The enlargement of bores 76, 80 enables adjustment of the positions of the knife holders 70, 72, towards or away from one another.

Both the front knife holder 70 and the rear knife holder 72 carry knives, the front knife holder carrying front knife 84 and the rear knife holder 72 carrying rear knife 86. The front knife 84 is secured to its holder 70 by a bolt 88 passing through a recessed enlarged bore 90 in the front knife, through an enlarged bore 92 in the front knife holder 70 and being secured there by a nut 94. As shown in FIG. 4, there are desirably several such bolt assemblies to hold the front knife 84 and rear knife 86 periodically along their lengths, rigidly in place with respect to their knife holders 70, 72.

Slight adjustments of the front knife 84 and the rear knife 86, toward and away from the center of the cutting cylinder, with respect to their own knife holders 70, 72 are possible, by the provision of set screw adjustments. Specifically, set screws plates 96 are fixed by flat-head screws 93 in the knife holders. Set screws 98 pass through the front and rear knives, 84, 86, and their rotation, with their tips bearing against the set screw plates 96, will cause slight adjustments in the positions of these knives. These adjustments are used to obtain an exact setting of these knives against the bottom knife, to be discussed later.

Both the front knife 84 and the rear knife 86 are "V" shaped at their cutting edges, with the wedges of these "V's" being tipped in a direction toward the center line CL taken with respect to the cutting cylinder 56.

The facing interiors of the front knife 84 and rear knife 86 carry guide plates 100, 102, respectively, which define between them, an opening or gap extension 104, see FIG. 3, which leads into and is in alignment with the gap 66, which leads into and is in alignment with the bore 64 of the cutting cylinder.

Situated below the cutting cylinder, to act as a shear for both the front knife 84 and the rear knife 86, is a bottom knife holder 106 which retains a bottom knife 108. To this end, a recess 110 is formed at an angle in the bottom knife holder 106, and the knife 108 is held there by bolts 112 which pass through enlarged bores 114 in the bottom knife 108 and into the bottom knife holder 106. Slight adjustments can be made in the position of the bottom knife 108, by means of a set screw 116, which passes through a bracket 118 fixed to the bottom knife holder 106, and whose tip contacts the lower end of the bottom knife 108.

The cutting edges of front and rear knives 84, 86, are skewed by the configuration of the knife holders, with respect to the axis of the cutting cylinder. The cutting edge of the bottom knife is offset, by the configuration of the bottom knife holder, at an opposite angle. By this relationship, these knives cut by a shearing action, with cutting points that move transversely of the folded webs W3 and W4.

A suction system operates within the gap-cutting apparatus 10. This system includes a stationary sleeve 120 which fits within the bore 64 of the cutting cylinder. The sleeve 120, shown in FIGS. 3, 5, 6 and 9, extends beyond both sides of the cutting cylinder 56, and has protruding ends 120*a* and 120*b*. The sleeve 120 is divided into two compartments by an internal sleeve suction divider 122, with each compartment having a sleeve slot 124, 126, these being located on either side of the sleeve suction divider 122.

The sleeve 120 is held stationary within the cutting cylinder 56, by a pair of sleeve holding brackets 128. These brackets may be tightened about the protruding ends 120*a* and 120*b* of the sleeve by sleeve holding bracket screws 130. The sleeve holding brackets 128 are attached to the frame plates 38, 40.

While in the drawings, only one pair of knife holders with their knives are shown, there may be numerous such spaced pairs situated about the cutting cylinder, depending upon the nature and form of the printed web product. There are at least two pairs of knives on a cylinder, thereby forming two gaps per rotation of the cutting cylinder. The number of pairs of knives may be odd or even.

The suction system further includes a low-pressure source from the input side of a blower, from which runs a suction tube 142, which splits into two branches 144, 146. As can be seen in FIG. 1, branch 144 runs to one side of the cutting cylinder while branch 146 runs first parallel to and below the cutting cylinder and then to the other side of the cutting cylinder. As seen in FIGS. 4 and 5, branch 144 is held to the sleeve end 120*b* by tube clamp 148.

The gap-cutting apparatus 10 also includes at its exit end, as seen in FIGS. 1 and 2, a delivery system comprising a conveyor belt mechanism 150 including a frame 152 and several conveyor belts 154 trained for horizontal movement, the belts being driven by a conveyor belt pulley 156 in turn driven by a belt 158 from the drive gear 62.

The drive train mentioned previously has a drive shaft 132, see FIG. 2, which extends from the driving motor of the web press, not shown, and is supported by a pillow block 134 resting upon the base plate 36. The drive shaft 132 drives a timing belt 136 which acts on a timing belt pulley 138, which in turn drive a drive gear box 140. This causes rotation of the drive gear 62, shown in FIG. 5, which meshes with and rotates the cutting cylinder gear 60.

OPERATION OF THE GAP-CUTTING APPARATUS

The mechanical components of the gap-cutting apparatus 10 have now been fully described, and it will be advantageous for a full understanding of the present invention, to discuss said apparatus in terms of function.

The plow-folding apparatus 12, which is in-line at the end of a web press, serves to present a number of folded webs W3 and W4 to the gap-cutting apparatus. As these enter such apparatus, they are driven by the feed roller 52 which acts against the pressure wheels 50, to continue to drive the folded webs W3 and W4 at a determined speed toward the cutting cylinder 56. As the folded webs W3 and W4 do so, they slide over and are supported by the web support 54.

As the webs W3 and W4 come closely into adjacency with the cutting cylinder, they are cut transversely first by the front knife 84, which is being rotated by the cutting cylinder 56. This cutting action of the front knife 84 takes place against the bottom knife 108, in a shearing action.

Momentarily thereafter, the rear knife 86 comes into contact with a slightly rearward area of the folded webs W3 and W4, the rear knife 86 also accomplishing its shearing action by acting against the bottom knife 108. At this moment in time, a web gap or trim strip S1, see FIG. 3, has been cut. The strip S1, as shown in the embodiment of the drawings, is of two-leaf thickness, since the webs W3 and W4 are folded on themselves.

The low-pressure source through vacuum tube 142 and branches 144 and 146, applies reduced pressure through both sides of the stationary sleeve 120. Again, as best seen in FIG. 3, since the sleeve slots 124, 126 are now in alignment with the gap 66 in the cutting cylinder which is in turn in alignment with the gap extension 104 between the knife holders 70, 72, low pressure is applied to the upper face of the trim strip S1. Ambient air pressure is applied to the lower face of the strip S1 and the resulting air flow tends to propel the strip quickly upwardly toward the center or bore of the cutting cylinder 56 and the sleeve 120. From its initial position between the front and rear knives 84 and 86, the strip S1 moves up to the position shown at S2, somewhat axially centrally of the stationary sleeve. As shown in FIGS. 4 and 5, this strip S2 moves towards one or the other end of the stationary sleeve 120 in the path P1 or P2 and then through either one of the branches 144 or 146, to a deposit area. For each rotation of the cutting cylinder, the front and the rear knives cut a trim strip from the webs W3 and W4, the process continuing without interruption.

As mentioned previously, there are at least two pairs of knives mounted on each cylinder. For this purpose, there are additional gaps 66*a*, 66*b* in this cylinder (see FIG. 3). The stationary sleeve, by having its slots 124, 126 opening downwardly toward the bottom knife, shuts or seals these additional gaps 66*a*, 66*b*, which are not at that point in time involved in the gapping action. Therefore, air flow can act only on the strip S1 located between the pair of knives which are involved in shearing action.

The aforesaid system quickly and efficiently clears strips which have been cut from the folded webs W3 and W4, so as to remove the same from the cutting area. If an inefficient or ineffective system were utilized, such strips would quickly block the gap 104, so that further gapping could not take place.

In addition to the spaced pair of knives, the cutting cylinder may carry one or more conventional knife blades, which can make single transverse cuts in any web presented to the cylinder.

The circumferential speed of the knife blades is greater than the linear speed of the web. Thereby, the cutting cylinder pulls against the web W3 or W4, tending to eliminate any bubbling which might form in the web. Such bubbling commonly occurs in any moving web, when such web is impacted by a knife blade.

To compensate for the fact that the knives are traveling faster than the web, the distance between the front and rear knives is greater than the width of the trim strip desired to be cut.

Strips down to 1/16" in width can be gapped by the present apparatus, this being a width that is considerably smaller than that which can be achieved by existing machinery. This is possible by eliminating any strip holding mechanism from between the knives (see U.S. Pat. No. 4,113,243) and by the provision of the stationary sleeve which permits air flow to be applied only to the strip at the cutting area.

By continuing such process, again as shown in FIG. 3, a web product P is formed, which is shingled, leading end over trailing end by the conveyor mechanism 150 and thereby such products P are continuously removed from the area of the cutting cylinder. They are then brought to the stacker unit 14 for stacking purposes.

Figure 8:
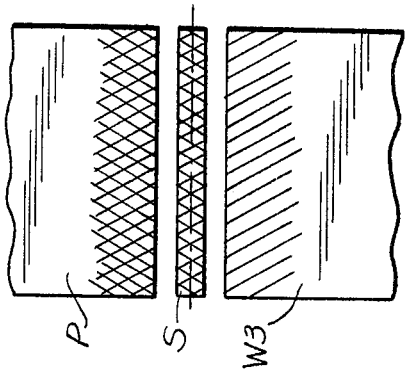
FIGS. 7 and 8 are views of the slit and folded web, shown before and after operation thereon by the gap-cutting apparatus.
Figure 7:
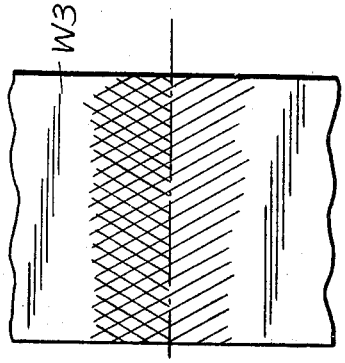
Figure 9:
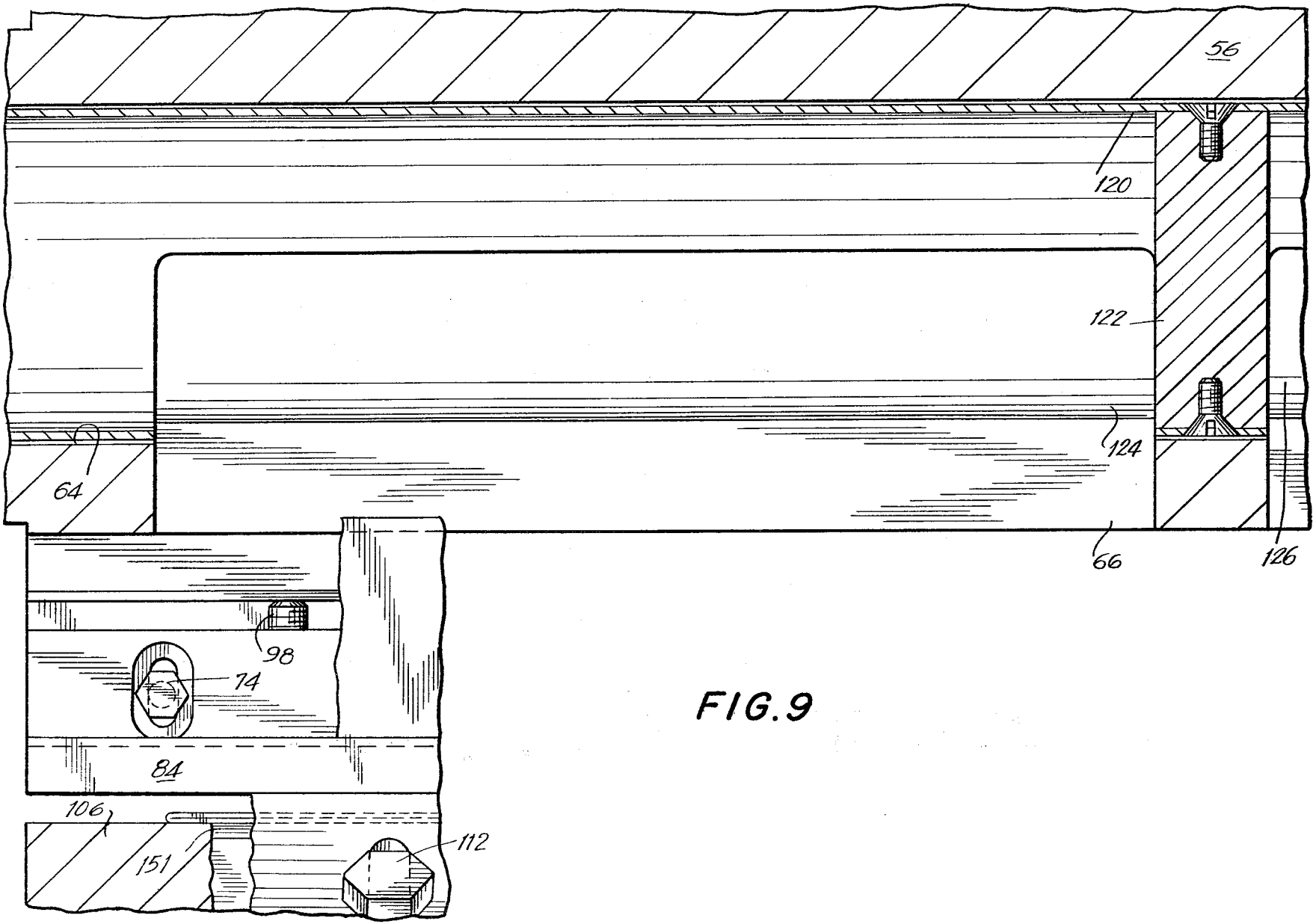
FIG. 9 is an enlarged partial cross-sectional view of the cutting cylinder and the suction sleeve, taken generally along the line 9—9 of FIG. 3.

A folded web W3 is shown in FIG. 7. After operation by the present gap-cutting apparatus, it is shown at a later stage in FIG. 8. There, the web W3 has had a thin gap or strip cut from it, leaving the finished web product P.

What is claimed is:

1. Apparatus in-line with a web press for continuously cutting and removing thin trim strips from a moving web to form web products, the apparatus being capable of cutting and removing such trim strips having a width as small as 1/16 of an inch, the apparatus including:

a frame;

a cutting cylinder operating on the web at a cutting area, the cylinder having an elongated bore and a number of gaps leading to said bore;

means for rotating said cutting cylinder on the frame;

pairs of knives on the cutting cylinder for cutting the web, each pair of knives defining an opening leading into a gap and then into said bore;

means for mounting the knives of each pair of knives on the cutting cylinder so as to enable adjustment of the width of the gap between said knives, the knives being mounted so as to provide a gap between them greater than the width of the trim strip intended to be cut;

the rotating means driving the knives at a speed greater then the speed of the moving web at the cutting area;

means for feeding web to the cutting cylinder so that the knives cut trim strips continuously in said web at a cutting area to form web products; and means for directing an air flow through the opening at the cutting area so as to move cut strips at the cutting area into the gap between the cutting knives and then into the bore of the cutting cylinder.

2. Apparatus as set forth in claim 1 wherein the air flow directing means directs the air flow only through the opening between the pair of knives at the cutting area, the directing means including a sleeve disposed within the bore, the sleeve having a slot oriented toward the cutting area and in communication with the opening between a pair of knives at the cutting area.

3. Apparatus as set forth in claim 2, wherein the sleeve is stationary with respect to the cylinder, such that the air flow is applied only to the strip at the cutting area.

4. Apparatus as set forth in claim 3, wherein the sleeve is divided into two sections and extends beyond the ends of the cylinder, each of said sections having a slot in communication with the cutting area for removal of the strips.

5. Apparatus as set forth in claim 4, wherein the cutting cylinder has several gaps, one in communication with each opening between each of the pairs of knives.

6. Apparatus as set forth in claim 1 further including shearing means coacting with the knives for cutting strips from the web at a cutting area.

7. Apparatus as set forth in claim 6, wherein the shearing means includes a shearing knife situated below the cutting cylinder.

8. Apparatus as set forth in claim 1 wherein each of the pairs of knives carried on the cutting cylinder have cutting edges, the cutting edges of each of the pairs of knives being skewed angularly inwardly toward a transverse center line taken with respect to the cutting cylinder.

9. Apparatus as set forth in claim 7 wherein the shearing knife has a cutting edge, the cutting edge of the shearing knife being angularly skewed with respect to the center line of the cutting cylinder in a direction opposing the cutting edges of each of the pairs of knives when situated in the cutting area.

10. Apparatus as set forth in claim 1 further including means for removing the cut web from the cutting area.

* * * * *